US009662709B2

(12) United States Patent
Friedrichs

(10) Patent No.: US 9,662,709 B2
(45) Date of Patent: May 30, 2017

(54) METHOD FOR PRODUCING A FUEL INJECTION ELEMENT HAVING CHANNELS, AND A FUEL INJECTION ELEMENT

(76) Inventor: Arno Friedrichs, Kulmbach (DE)

( * ) Notice: Subject to any disclaimer, the term of this patent is extended or adjusted under 35 U.S.C. 154(b) by 223 days.

(21) Appl. No.: 13/513,054

(22) PCT Filed: Oct. 29, 2010

(86) PCT No.: PCT/EP2010/066444
§ 371 (c)(1),
(2), (4) Date: May 31, 2012

(87) PCT Pub. No.: WO2011/079979
PCT Pub. Date: Jul. 7, 2011

(65) Prior Publication Data

US 2012/0261497 A1 Oct. 18, 2012

(30) Foreign Application Priority Data

Dec. 29, 2009 (DE) ..... 10 2009 060 844

(51) Int. Cl.

| | |
|---|---|
| ***F02M 61/18*** | (2006.01) |
| ***F02M 61/16*** | (2006.01) |
| ***B22F 3/20*** | (2006.01) |
| ***B22F 5/10*** | (2006.01) |
| ***B28B 3/26*** | (2006.01) |

(Continued)

(52) U.S. Cl.
CPC ..... *B22F 3/20* (2013.01); *B22F 5/10* (2013.01); *B28B 3/26* (2013.01); *B28B 11/003* (2013.01); *F02M 61/168* (2013.01); *F02M 61/1806* (2013.01); *B22F 2005/004* (2013.01); *F02M 2200/9007* (2013.01); *F02M 2200/9053* (2013.01)

(58) Field of Classification Search
CPC ..... F02M 61/18; F02M 61/1806; F02M 61/1813; F02M 61/182; F02M 61/1826; F02M 61/1846; F02M 61/1853
USPC ..... 239/533.3, 533.2, 463, 468, 472, 475, 239/533.12, 601, 585.1–585.5, 88–93
See application file for complete search history.

(56) References Cited

U.S. PATENT DOCUMENTS 4,360,162 A * 11/1982 Eckert ..... F02M 61/06 239/533.4
5,438,858 A 8/1995 Friedrichs
5,586,726 A 12/1996 Furuya et al.
(Continued)

FOREIGN PATENT DOCUMENTS

CN 1209521 A 3/1999
CN 2729342 Y 9/2005
(Continued)

OTHER PUBLICATIONS

International Search Report of PCT/EP2010/066444, Mar. 31, 2011.
(Continued)

*Primary Examiner* — Arthur O Hall
*Assistant Examiner* — Christopher R Dandridge
(74) *Attorney, Agent, or Firm* — Collard & Roe, P.C.

(57) ABSTRACT

The invention relates to a method for producing a fuel injection element having channels, as well as to a fuel injection element. A fuel injection element according to the invention has helically extending channels and is produced with use of an extrusion tool.

5 Claims, 2 Drawing Sheets

(51) Int. Cl.

| | |
|---|---|
| ***B28B 11/00*** | (2006.01) |
| *B22F 5/00* | (2006.01) |

(56) References Cited

U.S. PATENT DOCUMENTS

| | | | | |
|---|---|---|---|---|
| 6,029,913 | A * | 2/2000 | Stroia et al. | F02M 61/1806 239/533.12 |
| 6,102,692 | A | 8/2000 | Döbbeling et al. | |
| 6,378,792 | B2 | 4/2002 | Fukaya et al. | |
| 6,964,383 | B2 * | 11/2005 | Heyse | F02M 51/0671 239/533.12 |
| 6,994,279 | B2 * | 2/2006 | Saito et al. | 239/533.12 |
| 7,003,880 | B2 | 2/2006 | Morita | |
| 7,841,544 | B2 * | 11/2010 | Haddock et al. | 239/74 |
| 8,225,602 | B2 * | 7/2012 | Cavanagh et al. | 60/295 |
| 2002/0140125 | A1 | 10/2002 | Friedrichs | |
| 2004/0129806 | A1 * | 7/2004 | Dantes | F02M 51/0685 239/533.12 |
| 2004/0178287 | A1 * | 9/2004 | Okamoto | F02M 51/0671 239/596 |
| 2006/0192036 | A1 * | 8/2006 | Joseph | 239/596 |
| 2009/0025681 | A1 | 1/2009 | Takahashi et al. | |
| 2012/0305674 | A1 * | 12/2012 | Buehner et al. | 239/533.2 |

FOREIGN PATENT DOCUMENTS

| | | | | |
|---|---|---|---|---|
| CN | 2893431 | Y | 4/2007 | |
| CN | 101160459 | A | 4/2008 | |
| CN | 101206029 | A | 6/2008 | |
| CN | 100579690 | C | 1/2010 | |
| DE | 197 36 902 | A1 | 3/1999 | |
| DE | 199 15 874 | | 10/1999 | |
| DE | 100 49 517 | | 4/2002 | |
| DE | 102 46 403 | | 4/2003 | |
| DE | 10 2009 000 172 | A1 | 7/2010 | |
| EP | 1 120 554 | A1 | 8/2001 | |
| JP | 43-20403 | A | 9/1968 | |
| JP | S61-058967 | A | 3/1986 | |
| JP | H05231271 | A | 9/1993 | |
| JP | H08-189443 | A | 7/1996 | |
| JP | H 10-288131 | A | 10/1998 | |
| JP | 10-311264 | * | 11/1998 | F02M 51/06 |
| JP | H10311264 | * | 11/1998 | F02M 61/163 |
| JP | 2004-076723 | A | 3/2004 | |
| JP | 2004-510916 | A | 4/2004 | |
| JP | 2008-128146 | A | 6/2008 | |
| WO | WO 92/22390 | | 12/1992 | |
| WO | WO 2004/030850 | | 4/2004 | |
| WO | WO 2009/055315 | * | 4/2009 | F02M 47/02 |

OTHER PUBLICATIONS

Response to the Written Opinion of the International Search Authority, Jul. 26, 2011.

European Office Action in EP 10 779 492.7 received issued Feb. 28, 2017 with English translation of relevant parts.

* cited by examiner

METHOD FOR PRODUCING A FUEL INJECTION ELEMENT HAVING CHANNELS, AND A FUEL INJECTION ELEMENT

CROSS REFERENCE TO RELATED APPLICATIONS

This application is the National Stage of PCT/EP2010/066444 filed on Oct. 29, 2010, which claims priority under 35 U.S.C. §119 of German Application No. 10 2009 060 844.3 filed on Dec. 29, 2009, the disclosure of which is incorporated by reference. The international application under PCT article 21(2) was not published in English.

The invention relates to a method of producing a fuel injection element having channels and to a fuel injection element.

This fuel injection element can be a fuel injection nozzle, such as can be used in a fuel injection valve of a motor vehicle equipped with a petrol engine or a diesel engine, or can be an insert for a fuel injection nozzle.

Fuel injection nozzles comprise a nozzle body which is provided in the region of its nozzle tip with one or more channels. In operation of the vehicle fuel at high pressure is injected through these channels into a cylinder chamber of the engine. The channel or channels is or are of rectilinear form in such a manner that the fuel is injected in fan-shape into the cylinder chamber. It is thereby achieved that air and fuel intermix in the cylinder chamber in desired manner in order to cause combustion processes. The channels provided in the region of the nozzle tip are formed in the nozzle body by means of, for example, eroding or drilling, wherein a number of working steps is necessary in correspondence with the number of channels.

A fuel injection nozzle is known from DE 199 15 874 B4. This comprises a valve needle, a valve seat with a valve opening and a metal injection-moulded nozzle tip. An injection opening, which is formed as a fan-shaped slot with a predetermined opening angle, is provided in the nozzle tip. It is thereby to be achieved that the fuel injection nozzle can be produced in simpler manner and economically.

A method of producing a nozzle aperture plate for an injection nozzle and an injection nozzle equipped with a nozzle aperture plate of that kind are known from DE 102 46 403 B4. The nozzle aperture plate has an upper surface, a lower surface and a passage. The upper surface and the lower surface respectively define, with the passage, edges which are rounded. The surfaces of the rounded edges and the upper and lower surface are covered by tracks formed by a blasting process.

The object of the invention consists in indicating a new method, which is economic and can be realised in simple manner, for producing a fuel injection element having channels.

This object is fulfilled by a method of producing a fuel injection element having channels, comprising the following steps:

- producing a body, which consists of plastics material and has rectilinearly extending channels, by means of an extrusion tool,
- twisting the body having the rectilinearly extending channels in order to provide a body, which consists of plastics material, with helically extending channels,
- sintering the twisted body and
- cutting the length the sintered body to provide a fuel injection element having helical channels.

The advantages of the invention consist particularly in that the channels, which are produced by means of the claimed method, of the fuel injection element can be produced at the same time. This means, by comparison with known methods, a substantial saving of time for formation of the channels in the fuel injection element. Moreover, the channels produced by means of the claimed method have, by comparison with production by means of eroding, an improved surface. Moreover, it is possible to produce by the method according to the invention very fine channels with a diameter in the region of, for example, between 0.05 millimeters and 0.5 millimeters or even smaller.

The exit angle of the channels can vary based on the spacing of the channels from the central longitudinal axis of the element. The larger the spacing, the greater the exit angle. This makes it possible in advantageous manner to so select the exit angle that atomisation of the fuel delivered by the fuel injection element to the cylinder chamber of the motor vehicle is improved by comparison with the prior art. In advantageous manner the channels of a nozzle can also have different diameters. This has the consequence that the mixing of the fuel with air is also improved, which in turn leads to an improved combustion process, which produces a lower carbon dioxide emission than known fuel injection elements.

A fuel injection element according to the invention is in advantageous manner a fuel injection nozzle or an insert for a fuel injection nozzle. It can consist of hard metal, ceramic or steel. A fuel injection element of that kind can be produced comparatively simply, readily withstands the high demands in operation and has a high service life.

Further advantageous characteristics of the invention are evident from the following explanation thereof on the basis of figures, in which:

FIG. 1 shows a diagram of a longitudinal section through a fuel injection nozzle for clarification of a first form of embodiment for a fuel injection element according to the invention, FIG. 2 shows a diagram of a longitudinal section through a fuel injection nozzle for clarification of a second form of embodiment for a fuel injection element according to the invention, FIG. 3 show a sectional illustration of the fuel injection element according to FIG. 2 and FIG. 4 shows a flow chart for explanation of a method according to the invention.

FIG. 1 shows a diagram of a longitudinal section through a fuel injection nozzle for clarification of a first form of embodiment of the invention. The illustrated fuel injection nozzle 1 comprises a nozzle body 2 having an insert 3 adjacent the nozzle tip 2*a*. This insert 3, which is a fuel injection element, is constructed in the form of a plate, consists of hard metal, ceramic or steel and is fixedly connected with the nozzle body, for example by mechanically positive coupling, screw-connection, shrink-fitting or sintering. The insert 3 has continuous channels which connect the nozzle interior space 7 of the fuel injection nozzle 1 with the interior space 8 of a cylinder of the motor. Fuel, which is present in the nozzle interior space 7 under high pressure, is respectively sprayed through these channels into the cylinder space 8. The channels, of which in FIG. 1 merely two are shown and are denoted by the reference numerals 4 and 5, each extend helically through the insert 3. This helical course is selected in such a manner that the fuel issues from the insert 3 at one or more desired angles. Through suitable selection of this angle it is possible to achieve an improved distribution of the fuel in the cylinder space and thereby an improved atomisation of the fuel. This in turn improves the mixing of the fuel with air within the respective cylinder and thereby the combustion process.

FIG. 2 shows a diagram of a longitudinal section through a fuel injection nozzle for clarification of a second form of embodiment of the invention. The illustrated fuel injection nozzle 1, which is a fuel injection element, comprises a nozzle body 2 which has continuous channels in the region of the nozzle tip 2*a*. These channels connect the nozzle interior space 7 of the fuel injection nozzle 1 with the interior space 8 of a cylinder of the motor. Fuel, which is present in the nozzle interior space under high pressure, is sprayed through these channels into the cylinder space 8. The channels, of which in FIG. 2 merely two are shown and are denoted by the reference numerals 4 and 5, each extend helically through the region of the nozzle tip 2*a*. This helical course is selected in such a manner that the fuel issues from the nozzle body 2 at one or more desired angles. Through suitable selection of this angle an improved distribution of the fuel in the cylinder chamber and thereby an improved atomisation of the fuel can be achieved. This in turn improves the mixing of the fuel with air within the respective cylinder and thereby the combustion process. In this second form of embodiment the nozzle body 2 is of integral construction and consists of hard metal, ceramic or steel.

Fuel issuing from the channels 4 and 5 is denoted in FIGS. 1 and 2 by the reference numeral 6.

In this method, in accordance with Step S1 production takes place—by means of an extrusion tool—of a body consisting of a plastics material and having rectilinearly extending channels. This plastics material is hard-metal powder provided with a plasticiser, ceramic powder provided with a plasticiser or steel powder provided with a plasticiser. In order to produce the mentioned rectilinearly extending channels the extrusion tool has in its interior, for example, a thread holder to which are fastened threads which extend to the region of the nozzle mouthpiece of the extrusion tool and serve as space-reserving means of the channels for the plastics material flow extruded by the extrusion tool.

According to a Step S2 twisting of the body having rectilinearly extending channels is carried out so as to provide a body, which consists of plastics material, with helically extending channels. This twisting is preferably produced in that the nozzle mouthpiece of the extrusion tool is constructed to be rotatable and is rotated during the extrusion process.

The body, which leaves the extrusion tool and consists of plastics material and which already has helically extending channels, is sintered outside the extrusion tool in a Step S3.

The sintered body is subsequently cut to length in a Step S4 in order to provide a fuel injection element having helically extending channels.

Figure 1:
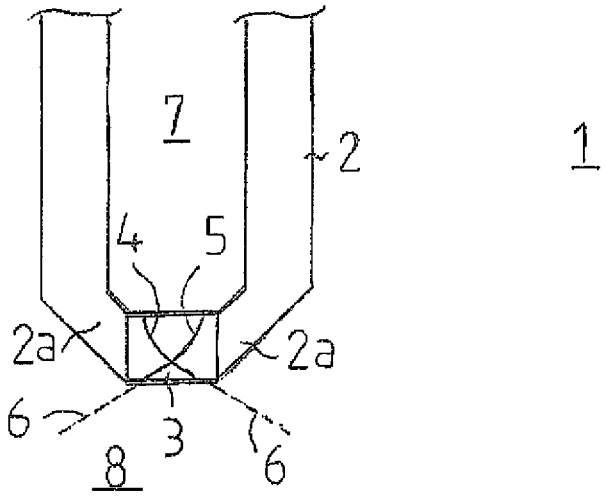
Figure 2:
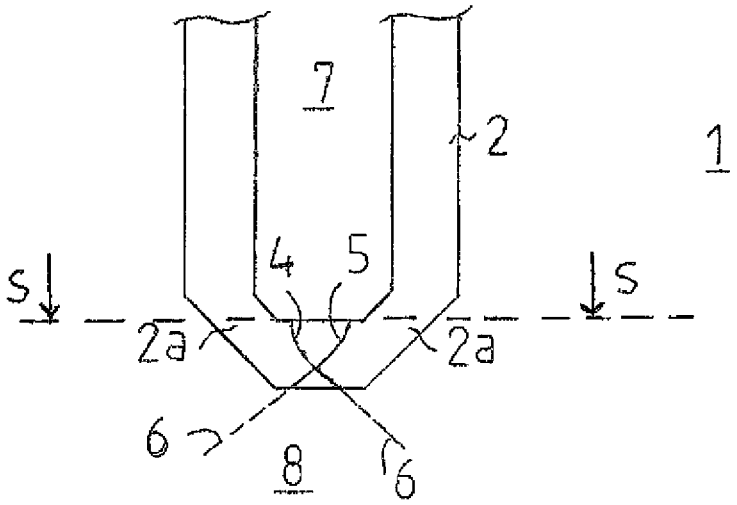
Figure 3:
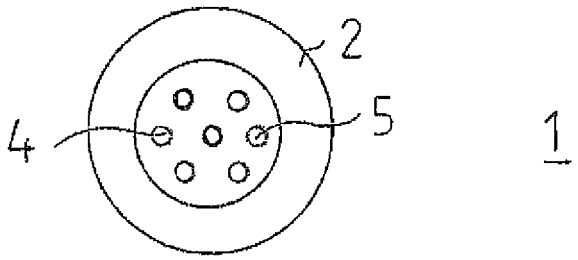
FIG. 3 shows a sectional illustration of the fuel injection nozzle according to FIG. 2 in the direction of the section line S-S shown in FIG. 2. It is apparent that the fuel injection nozzle has in the region of its nozzle tip a plurality of channels, the inlets of which are approximately uniformly distributed in the region of the nozzle tip.
Figure 4:
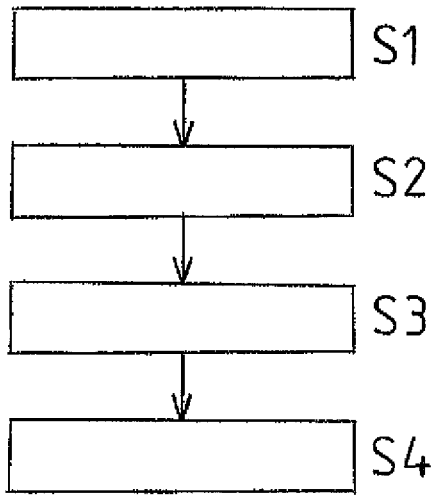
FIG. 4 shows a flow chart for clarification of a method for producing a fuel injection element having channels.

An alternative consists in that the twisting taking place in Step S2 is produced in that the rod-shaped body of plastics material leaving the extrusion tool is initially cut to length outside the extrusion tool and then subjected to a twisting in which, with support over its entire length on a support, it is subjected by means of a friction surface arrangement to a rolling motion at a speed which changes linearly and constantly over the length of the body. This twisted body is subsequently sintered in a Step S3 and thereafter cut to length in a Step S4 in order to provide fuel injection elements in the form of inserts 3, as illustrated by way of FIG. 1.

The sintered and cut-to-length body can if required still be subjected to further processing, for example a grinding process.

The method described in the foregoing by way of embodiments enables simplified production of fuel injection elements having fuel injection channels. The extrusion method used moreover not only delivers an improved surface of the channels, but also enables production of all channels in a single working step. These channels can, in advantageous manner, also have different diameters. Moreover, by means of a method according to the invention it is possible to produce very fine channels of which the diameter can lie in the range between 0.5 millimeters and 0.05 millimeters or if required can be even smaller. The exit angle of the channels from the fuel injection element increases with increasing spacing of the respective channel from the centre axis of the element. Channels lying in the proximity of the centre axis spray out the fuel substantially in the direction of the centre axis. With increasing spacing of the channels from the centre axis, spraying out of the fuel takes place at an angle which increasingly differs from the direction of the centre axis.

REFERENCE NUMERAL LIST

1 fuel injection nozzle
2 nozzle body
3 insert
4 helically extending channel
5 helically extending channel
6 fuel discharge
7 nozzle interior space
8 cylinder interior space

The invention claimed is:

1. Fuel injection nozzle (1) comprising a nozzle body (2) provided with a nozzle tip (2*a*), wherein the nozzle tip has continuous channels which connect a nozzle interior space of the fuel injection nozzle with the interior space of a cylinder, wherein the channels (4, 5) each extend helically through the nozzle tip (2*a*) such that the channels directly open out into the cylinder, wherein a helical course of the channels is selected such that the fuel issues from the nozzle body at several different desired exit angles relative to the nozzle body, wherein the exit angle increases with increasing distance between the respective channels (4,5) and a center axis of the fuel injection nozzle (1) such that channels close to the centre axis inject the fuel substantially in the direction of the center axis, and wherein with increasing distance between the channels and the center axis the fuel is injected at an angle which increasingly differs from the direction of the center axis.

2. Fuel injection nozzle according to claim 1, wherein the nozzle tip has an insert (3) which connects the nozzle interior space of the fuel injection nozzle with the interior space of a cylinder and in which the helically extending channels are provided.

3. Fuel injection nozzle according to claim 1, wherein the nozzle body (2) is of integral construction.

4. Fuel injection nozzle according to claim 1, wherein the nozzle body consists of carbide metal, ceramic or steel.

5. Fuel injection nozzle according to claim 1, wherein it has helically extending channels of different diameter.

* * * * *